US007126556B1

(12) United States Patent
Wang

(10) Patent No.: US 7,126,556 B1
(45) Date of Patent: Oct. 24, 2006

(54) DIGITAL INDOOR ANTENNA DEVICE

(75) Inventor: Cheng-Si Wang, Hua Tan Hsiang (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 0 days.

(21) Appl. No.: 11/132,461

(22) Filed: May 18, 2005

(51) Int. Cl.
*H01Q 7/00* (2006.01)

(52) U.S. Cl. ..... 343/866; 343/869; 343/882; 343/732

(58) Field of Classification Search ..... 343/764, 343/866, 741, 732
See application file for complete search history.

(56) References Cited

U.S. PATENT DOCUMENTS 3,587,101 A * 6/1971 Nienaber ..... 343/702
5,552,796 A * 9/1996 Diamond ..... 343/742
5,764,194 A * 6/1998 Brown ..... 343/726
6,535,178 B1 * 3/2003 Wang ..... 343/882
6,917,793 B1 * 7/2005 Wang ..... 455/193.1
2005/0259023 A1 * 11/2005 Wang ..... 343/764

* cited by examiner

*Primary Examiner*—Trinh Vo Dinh
(74) *Attorney, Agent, or Firm*—James H. Walters

(57) ABSTRACT

A digital indoor antenna device having a casing, a pivotal seat, a circular antenna having two ends and a PCB in the casing. The pivotal seat attached to the casing has two mounting holes respectively in which the two ends of circular antenna are mounted. The circular antenna rotates on the casing to adjust the horizontal receiving angle. Therefore, the circular antenna device can receive larger intensity of horizontal polarized signals. In addition, the pivotal seat can be pivotally connected to the casing, so the circular antenna can rotate horizontally on the casing to search for different channel signals.

5 Claims, 5 Drawing Sheets

DIGITAL INDOOR ANTENNA DEVICE

BACKGROUND OF THE INVENTION

1. Field of the Invention

The present invention relates to a digital indoor antenna device and more particularly to a digital indoor antenna device having an adjustable receiving angle capability.

2. Description of Related Art

A UHF antenna device is usually a circular antenna to receive UHF signals transmitted through the air since the circular antenna is suitable to receive signals with different polarization, such as vertically, horizontally or circular polarized signals. With reference to FIG. 6, a circularly polarized signal has a radiation pattern consisting of two lobes that can be received by the circular antenna.

The UHF antenna device includes a main body, a signal processing circuit and a circular antenna. The signal processing circuit is mounted in the main body. The circular antenna is mounted vertically on the main body and is connected electronically to the signal processing circuit. The circular antenna on some UHF antenna devices turns horizontally and the UHF antenna device has an auto-searching capability. The circular antenna is pivotally connected to the top of the main body so the circular antenna can be rotated horizontally on the main body. If the main body further has a motor to drive the circular antenna, the circular antenna can be automatically rotated to different positions on the main body to search different channel signals.

The circular antenna can receive vertically and horizontally polarized signals, but cannot receive the largest intensity of these signals (about 30% loss) since the circular antenna only mounted vertically on the main body in normal use.

The present invention provides a digital indoor antenna device that has a horizontally adjustable receiving angle capability to obviate or mitigate the problems with conventional mechanical and electronic environment sensing instruments.

SUMMARY OF THE INVENTION

The main objective of the present invention is to provide a digital indoor antenna device to receive large intensity of horizontally polarized signals and decrease the interference other polarized signals.

A digital indoor antenna device having a casing, a pivotal seat, a circular antenna having two ends and a PCB in the casing. The pivotal seat attached to the casing has two mounting holes respectively in which the two ends of circular antenna are mounted. The circular antenna rotates on the casing to adjust the horizontally receiving angle. Therefore, the circular antenna device can receive larger intensity of horizontal polarized signal. In addition, the pivotal seat can be pivotally connect to the casing, so the circular antenna can rotate horizontally on the casing to search for different channel signals.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
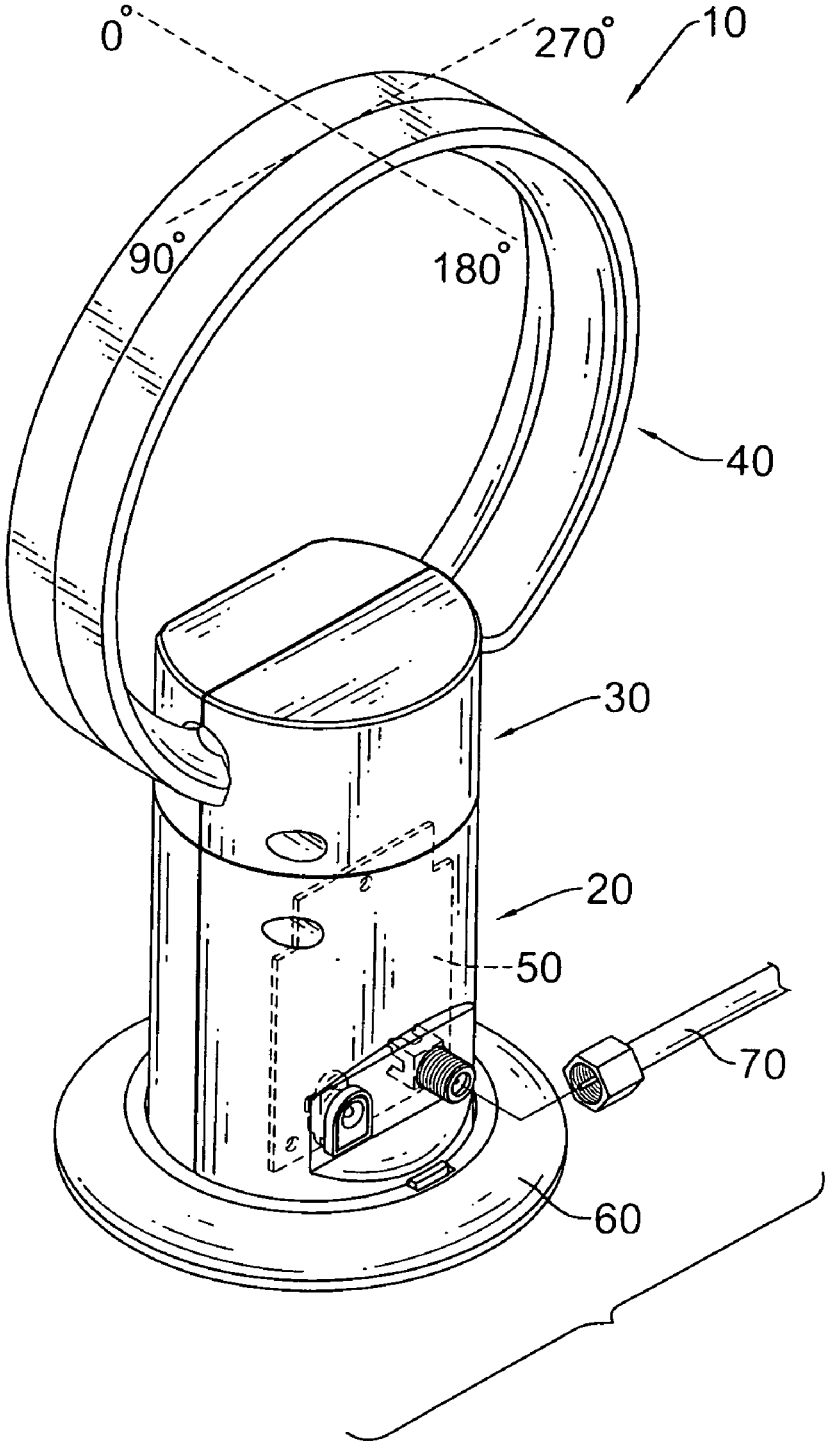
FIG. 1 is an exploded perspective view of a digital indoor antenna device in accordance with the present invention.
Figure 4:
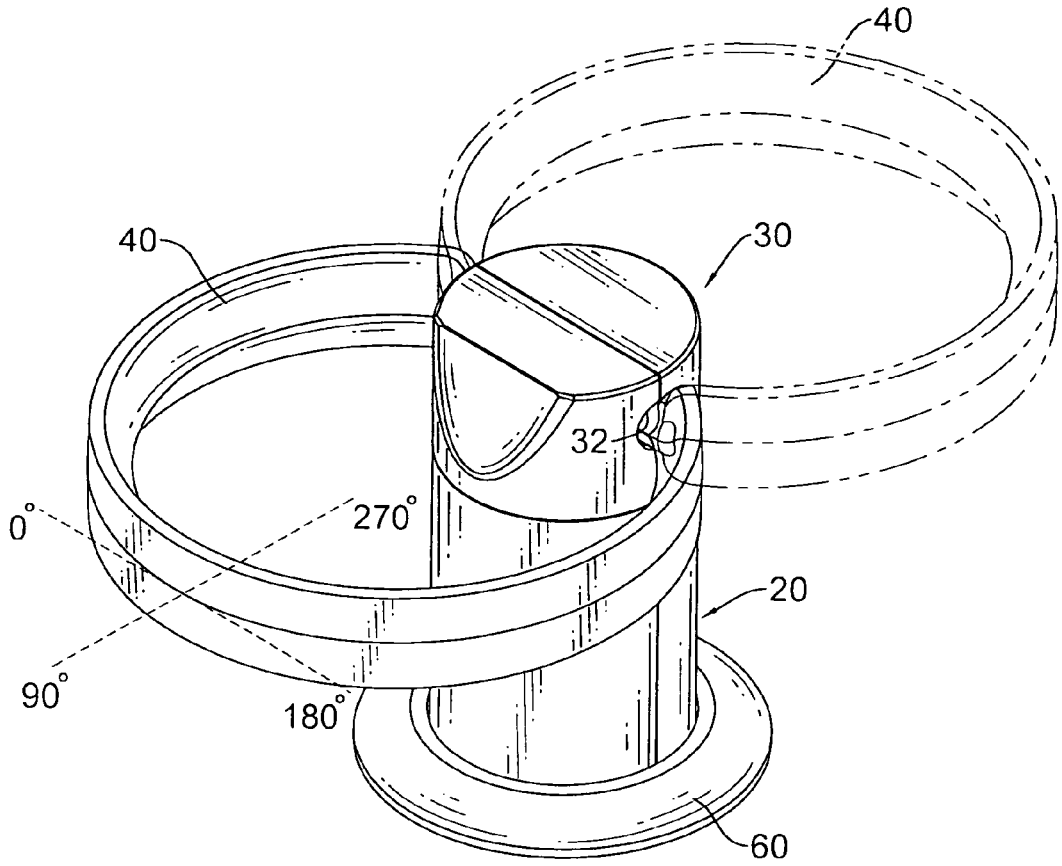
FIG. 4 is an operational perspective view of the digital indoor antenna device in FIG. 1.

With reference to FIG. 1, a digital indoor antenna device (10) in accordance with the present invention has a casing (20), a pivotal seat (30), a circular antenna (40), a PCB (50) and an optional base (60). With further reference to FIG. 4, the pivotal seat (30) is connected to the casing (20), and the circular antenna (40) pivotally is connected to the pivotal seat (30), so the circular antenna (40) is mounted pivotally on the casing (20).

Figure 2:
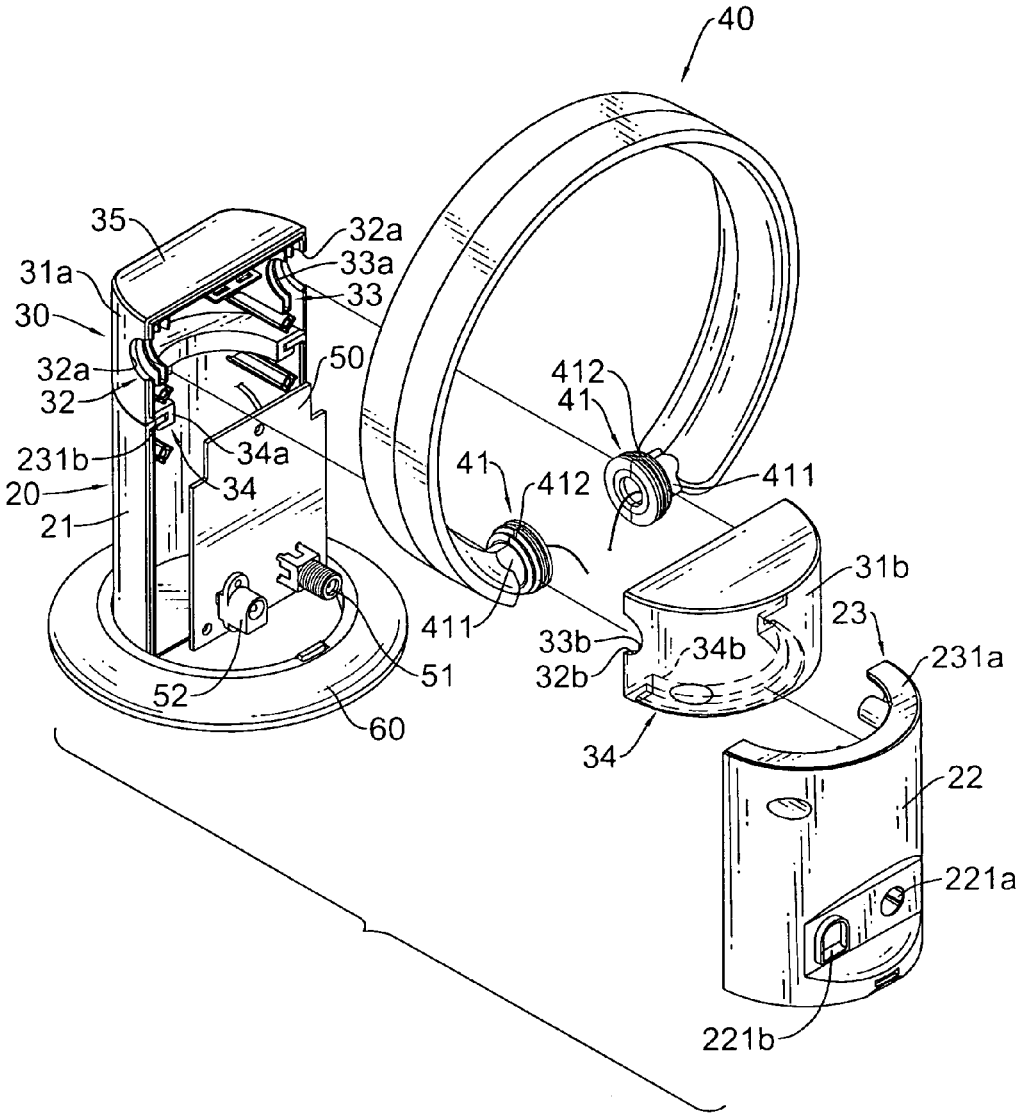
FIG. 2 is a perspective view of the digital indoor antenna device in FIG. 1.

With further reference to FIG. 2, the casing (20) has a top and a bottom and can have a front cover (21), a rear cover (22) and an optional track (23). The rear cover (22) is attached to the front cover (21) to define an interior cavity and has two through holes (221*a*, 221*b*). The track (23) is formed at and extends in from the top of the casing (20) and may comprise two semicircular tracks (231*a*, 231*b*). The semicircular tracks (231*a*, 231*b*) are formed respectively on and extend in from the top of the front and rear covers (21, 22) and form the track (23) when the front and rear covers (21, 22) are connected to each other.

The pivotal seat (30) is mounted on top of the casing (20) and has a closed top, an open bottom, a vertical sidewall, two mounting holes (32), two antenna rails (33), an optional bottom rail (34) and two optional body halves (31*a*, 31*b*). The mounting holes (32) are formed through the sidewall diametrically opposite to each other. The antenna rails (33) are formed on and extend down from the top inside the pivotal seat (30) and correspond respectively to the mounting holes (32). The bottom rail (34) is formed on and protrudes in from the open bottom and is mounted on the track (23) on the casing (20) to allow the pivotal seat (30) to rotate relative to the casing (20).

Each body half (31*a*, 31*b*) has a top (35), two vertical edges, a semicircular bottom edge, two semicircular mounting recesses (32*a*, 32*b*), two semicircular antenna rails (33*a*, 33*b*) and an optional semicircular bottom rail (34*a*, 34*b*). The two semicircular recesses (32*a*, 32*b*) are defined respectively in the vertical edges and form the mounting holes (32) when the body halves (31*a*, 31*b*) are connect to each other. The two semicircular antenna rails (33*a*, 33*b*) are formed on and extend down from the top (35) parallel respectively to the semicircular mounting recesses (32*a*, 32*b*) and form the antenna rails (33) when the two body halves (31*a*, 31*b*) are connected to each other.

Figure 3:
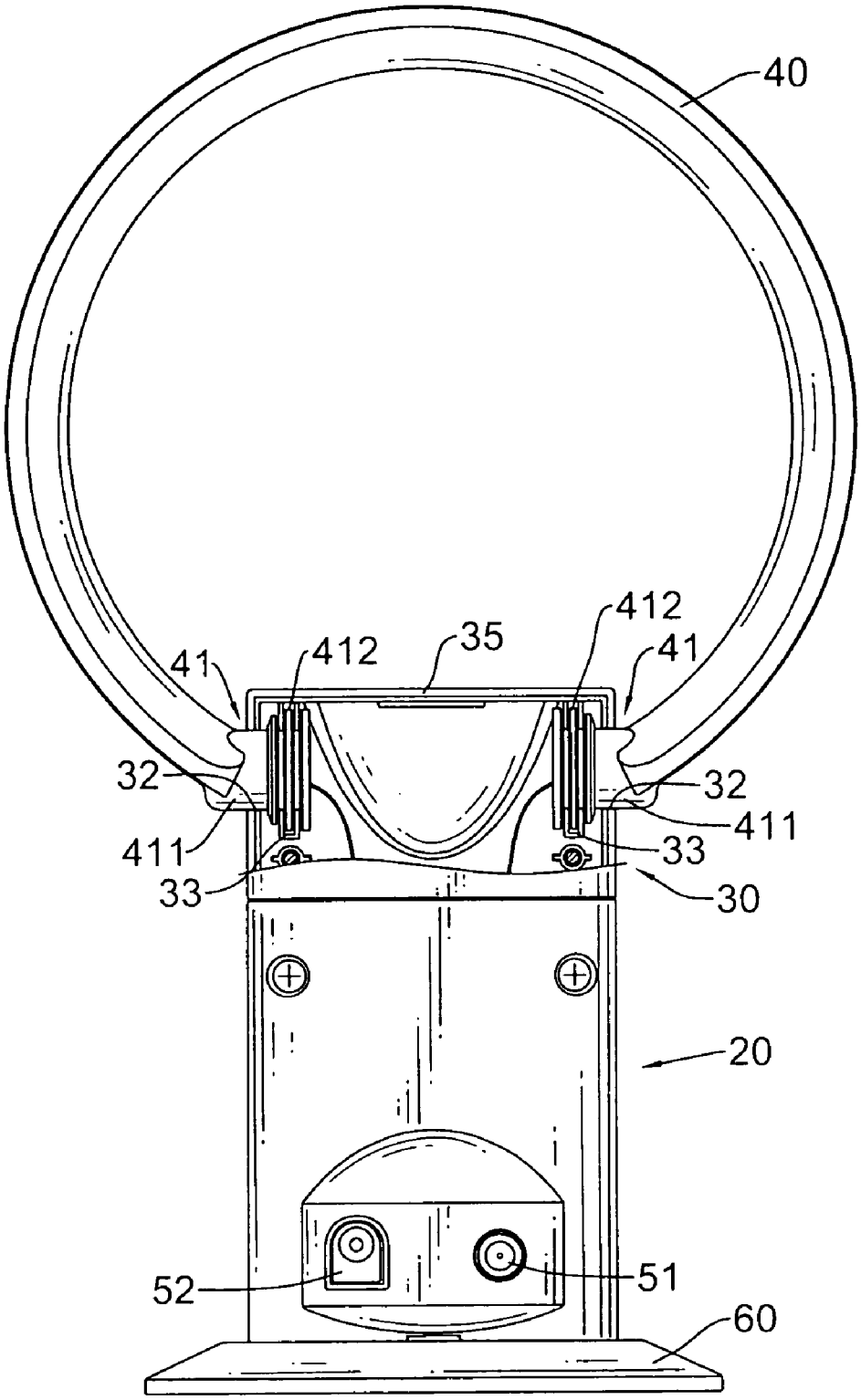
FIG. 3 is a front view in partial section of the digital indoor antenna device in FIG. 1.

With further reference to FIG. 3, the circular antenna (40) is pivotally mounted in the pivotal seat (30) so the circular antenna (40) rotates with the pivotal seat (30) to horizontally adjust to a receiving angle and has two ends. Each end has a spindle (41). Each spindle (41) is connected to the corresponding antenna rails (33*a*, 33*b*) of the pivotal seat (30) through the mounting holes (32*a*, 32*b*) in the pivotal seat (30) and has a neck (411) and at least one wheel (412). The at least one wheel (412) is connected to the neck (411). The necks (411) are rotatably mounted respectively in the mounting holes (32), and the wheels (412) are rotatably mounted respectively in the antenna rails (33).

The PCB (50) is mounted in the casing (20), is connected electronically to the circular antenna (40) and has a signal processing circuit, a terminal (51) and a power connector (52). The signal processing circuit is connected electronically to the circular antenna (40). The terminal (51) and the power connector (52) are connected to the PCB (50) and correspond to and protrude respectively through the two through holes (221*a*, 221*b*) in the rear cover (22). With further reference to FIG. 2, the power connector (52) is connected to an external AC to DC transformer to obtain DC power and supplies the DC power to the signal processing circuit. The terminal (51) connects to an external coaxial cable connector of a television through a coaxial cable (70).

The base (60) is attached to the bottom of the casing (20) and holds the PCB (50) in the interior cavity.

Figure 5:
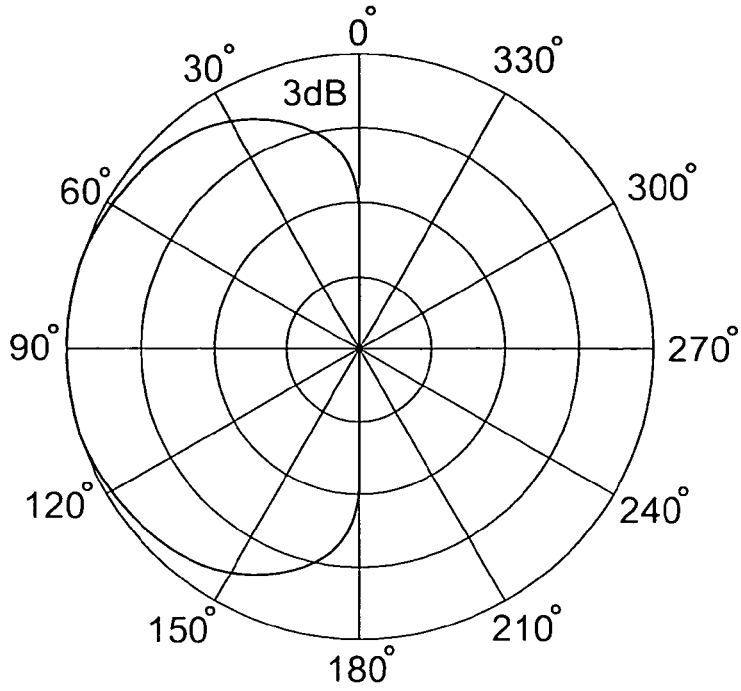
FIG. 5 is a radiation pattern received by the digital indoor antenna device in FIG. 1.
Figure 6:
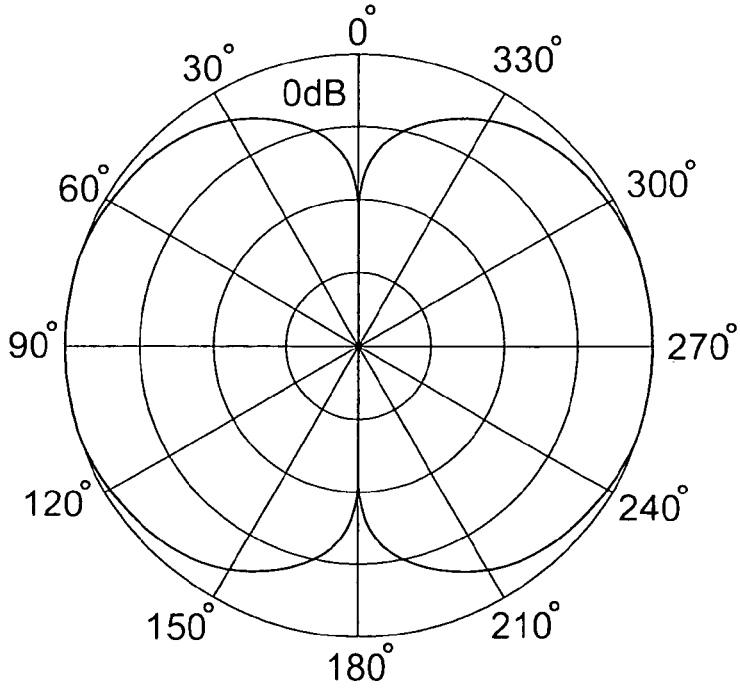
FIG.6 PRIOR ART
FIG. 6 is a radiation pattern received by a conventional circular antenna in accordance with the prior art.

With reference to FIG. 4, when the digital indoor antenna device is used to receive horizontally polarized signals, the receiving angle can be adjusted to be horizontal to receive larger intensity of the horizontally polarized signal. With further reference to FIG. 5, a horizontally polarized signal only has one radiation lobe so the circular antenna only receives the vertical polarized signal and also keeps from interference from the other polarized signals. With reference to FIGS. 5 and 6, the electromagnetic strength attenuation of horizontally polarized signal in FIG. 5 is larger than that of FIG. 6.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A digital indoor antenna device, comprising:

a casing having a top and a bottom;

a pivotal seat attached to the top of the casing and having:

a closed top;

an open bottom;

a vertical sidewall;

two mounting holes formed through the sidewall diametrically opposite to each other; and two antenna rails formed on and extending down from the top inside the pivotal seat and corresponding respectively to the mounting holes;

a circular antenna pivotally mounted in the pivotal seat and having two ends, each end having a spindle connected to a corresponding antenna rail of the pivotal seat through a corresponding mounting hole in the pivotal seat and having a neck rotatably mounted in the corresponding mounting hole; and at least one wheel rotatably mounted in the corresponding antenna rail; and a PCB with a signal processing function mounted in the casing, electronically connected to the circular antenna and having a terminal connected to the PCB and adapted to connect to an external coaxial cable connector; and a power connector connected to the PCB.

2. The digital indoor antenna device as claimed in claim 1, further comprising:

a track formed at and extending in from the top of the casing;

a bottom rail formed on and protruding in from the open bottom of the pivotal seat and mounted on the track on the casing to allow the pivotal seat to rotate relative to the casing.

3. The digital indoor antenna device as claimed in claim 1, wherein the casing comprises:

a front cover;

a rear cover attached to the front cover and having two through holes respectively through which the terminal and power connector extend.

4. The digital indoor antenna device as claimed in claim 1, wherein the pivotal seat comprises two body halves, and each body half comprises:

a top;

two vertical edges;

a semicircular bottom edge;

two semicircular through recesses defined respectively in the vertical edges and forming the mounting holes when the body halves are connected to each other;

two semicircular antenna rails formed on and extending down from the top of the body parallel respectively to the semicircular mounting recesses and forming antenna rails when the two body halves are connected to each other.

5. The digital indoor antenna device as claimed in claim 3, further comprising two semicircular tracks formed respectively on and extending in from the top of the front and the rear covers.

* * * * *